United States Patent [19]

Queren

[11] 4,178,588

[45] Dec. 11, 1979

[54] BURGLAR ALARM SYSTEM

[76] Inventor: James Queren, 218-07 43rd Ave., Bayside, N.Y. 11361

[21] Appl. No.: 921,903

[22] Filed: Jul. 5, 1978

[51] Int. Cl.[2] ..... G08B 13/06; H01H 27/00

[52] U.S. Cl. ..... 340/545; 200/61.62; 292/346; 340/550

[58] Field of Search ..... 340/545, 550; 200/61.59, 61.62, 61.64; 292/340, 341.12, 346, DIG. 41

[56] References Cited

U.S. PATENT DOCUMENTS

| | | | |
|---|---|---|---|
| 2,615,083 | 10/1952 | Krueger | 340/545 X |
| 3,295,124 | 12/1966 | Burleson et al. | 340/545 |
| 3,978,467 | 8/1976 | Albert | 340/545 X |
| 4,010,968 | 3/1977 | Rehfeld | 340/550 X |
| 4,029,919 | 6/1977 | Lunne | 340/545 X |

*Primary Examiner*—Donald J. Yusko
*Assistant Examiner*—Joseph E. Nowicki
*Attorney, Agent, or Firm*—Kurt Kelman

[57] ABSTRACT

A burglar alarm system is mounted in a doorway framing which comprises a reinforcement metal plate extending over a substantial portion of the wall studs and a substantial portion of one minor face of the door jamb, which plate is securely affixed to the wall stud and the minor door jamb face to cover a substantial region of the minor door jamb face adjacent and beyond the door latch bolt hole in the side rail. The alarm system comprises a pair of elongated copper sheets insulated from the metal plate and arranged between the plate and the minor door jamb face. The copper sheets extend side-by-side along a major portion of the reinforcement plate and are insulated from each other. The copper sheets are connected to an electric control circuit energizable to set off a burglar alarm and energized upon electrical contact being made by the sheets through a metal burglar tool used in an attempt to jimmy the door.

7 Claims, 5 Drawing Figures

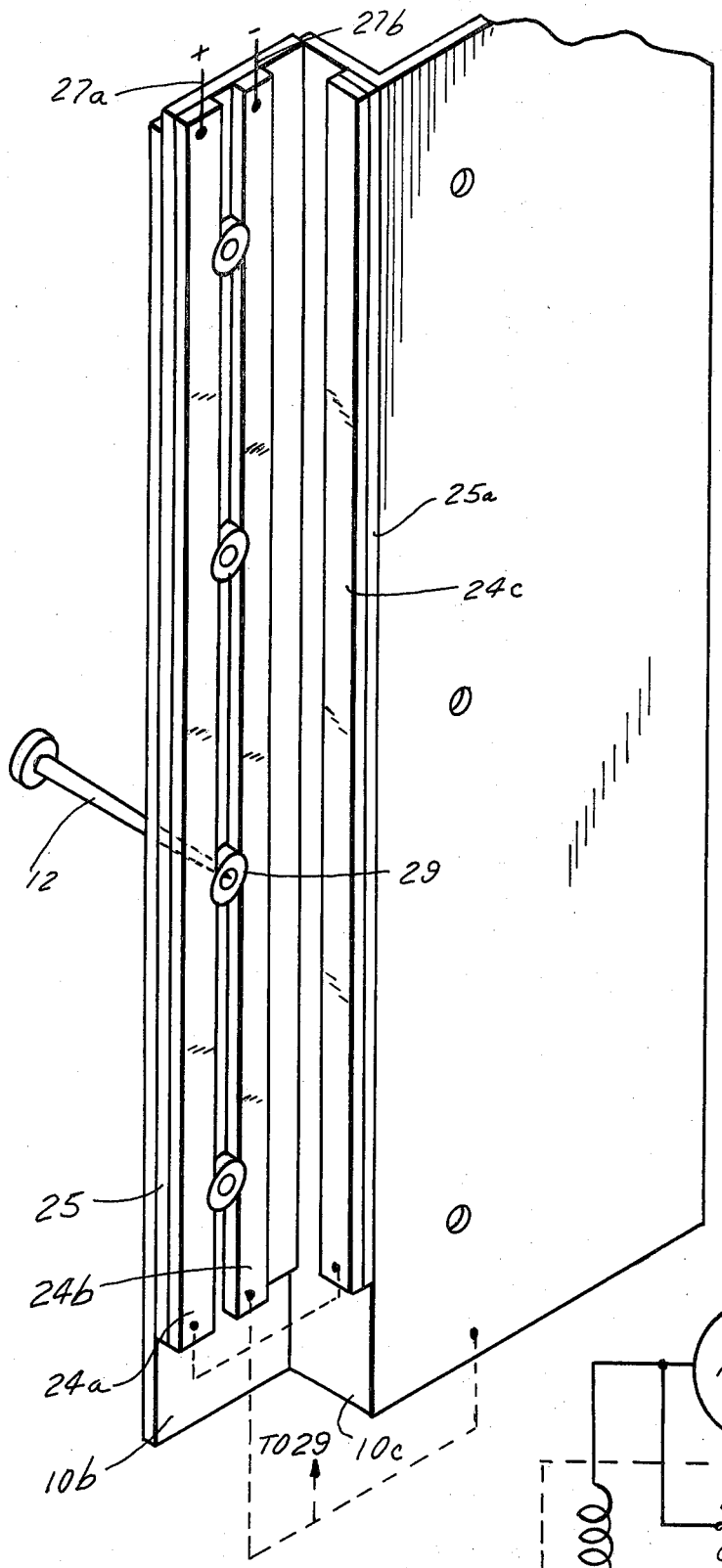
FIG.4
FIG.5
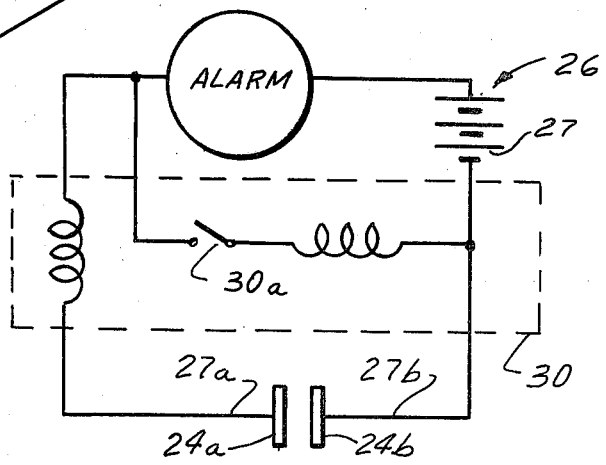

BURGLAR ALARM SYSTEM

BACKGROUND OF THE INVENTION

The present invention relates to a burglar alarm system mounted in a doorway framing, and more particuarly the secured doorway framing including a protective reinforcement steel plate preventing unlawful entry into a structure closed by a door, such as fully disclosed and claimed in my U.S. Pat. No. 4,074,484, dated Feb. 21, 1978, whose disclosure is incorporated herein by way of reference.

The doorway framing disclosed in my patent comprises a wooden door jamb having two substantially parallel major faces and two minor faces substantially perpendicular to the major faces. One of the major faces has a recessed end portion delimited by one of the minor faces and a shoulder constituting a stop for a door. The door jamb defines a door latch bolt hole in the recessed end portion. The door jamb is mounted on a wall including wooden stud means adjacent the other major face of the door jamb and the minor faces of the door jamb extend substantially parallel to the wall. A reinforcement metal plate extends over a substantial portion of the wall stud means and a substantial portion of the one minor face of the door jamb, and is securely affixed to the wall stud means and the one minor face of the door jamb, covering a substantial region of the minor door jamb face adjacent and beyond the door latch bolt hole. The securely affixed plate holds the door jamb firmly in position.

In my copending patent application Ser. No. 888,412, filed Mar. 20, 1978, I have disclosed an improvement in such a doorway framing, which comprises a rigid backer plate arranged in the narrow space between the other major face of the jamb and the wall, the backer plate being screwed to the other major face of the jamb whereby the door jamb is sandwiched between the striker and the backer plates and the striker plate is firmly anchored to the jamb. The disclosure of this application is incorporated hereby by way of reference.

SUMMARY OF THE INVENTION

It is the primary object of this invention to provide a simple but effective burglar alarm system for a doorway framing of this type.

This and other objects are accomplished in accordance with the invention by a pair of elongated electrically conductive sheets arranged between the minor door jamb face and the reinforcement plate, the electrically conductive sheets extending in side-by-side relationship along a major portion of the reinforcement plate and being electrically insulated from each other, an electrically insulating sheet arranged between the reinforcement plate and the pair of electrically conductive sheets, a burglar alarm, and an electric control circuit connected to the burglar alarm and energizable to set off the alarm, the circuit being connected to the electrically conductive sheets and being energized upon electrical contact being made between the sheets.

In this burglar alarm system, upon an attempt to jimmy the door open with an electrically conductive burglar tool, such as a crowbar or a screw driver, the tool will make contact between the two electrically conductive sheets to close and energize the electrical control circuit, setting off the alarm. Electrical burglar alarm circuits are well known and any such circuit may be used in combination with the electrically conductive sheets of the present invention. Copper being an excellent electrical conductor, it is the preferred material for the electrically conductive sheets.

BRIEF DESCRIPTION OF THE DRAWING

The above and other objects, advantages and features of this invention will become more apparent from the following detailed description of a now preferred embodiment thereof, taken in conjunction with the accompanying drawing wherein

FIG. 4 is a rear view of the metal reinforcement plate, on an enlarged scale, showing the mounting of a pair of electrically conductive sheets thereon; and FIG. 5 illustrates a burglar alarm control circuit.

DETAILED DESCRIPTION

Figure 1:
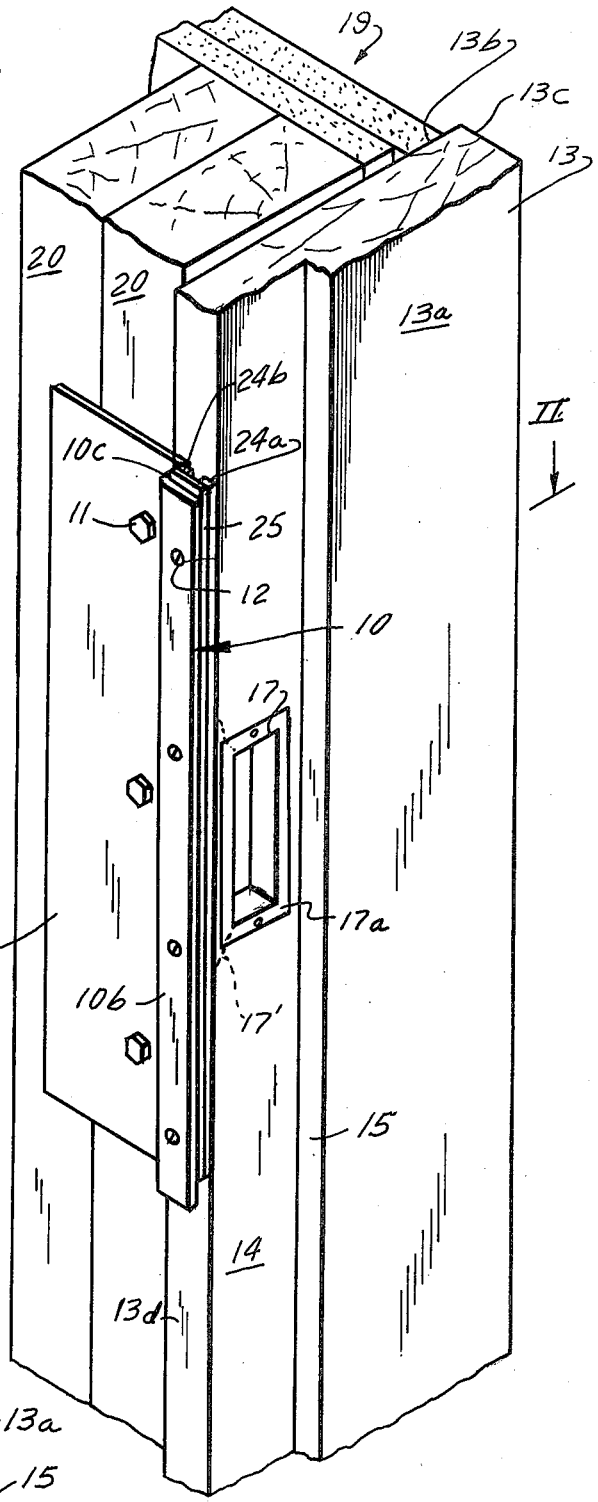
FIG. 1 is a partial perspective view of a portion of a doorway framing in the region of the door latch bolt hole, illustrating the overall structure.
Figure 2:
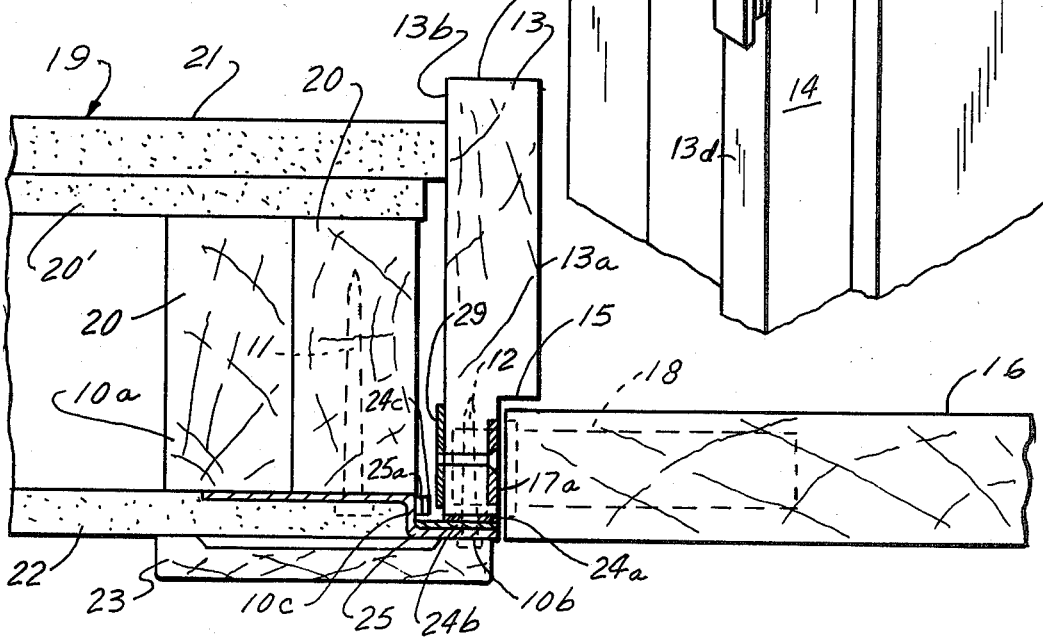
FIG. 2 is a transverse section along line II—II of FIG. 1, showing the mounting of the electrically conductive sheets, as well as a portion of the door, the covering wall board and a molding.

Referring now to the drawing and first to FIGS. 1 and 2, the doorway framing is generally conventional and comprises wooden door jamb 13 having two substantially parallel major faces **13*a*, 13*b* and two minor faces 13*c*, 13*d* substantially perpendicular to the major faces. Major face 13*a* has a recessed end portion 14 delimited by minor face 13*d* and shoulder 15 constituting a stop for door 16 (shown in FIGS. 2 and 3). Door jamb 13 defines door latch bolt hole 17 in recessed end portion 14. Recessed into door 16 is lock 18 which has a latch bolt arranged to project into hole 17 for locking the door. Striker plate 17*a* with a hole aligned with hole 17 is mounted over hole 17, all of this structure being entirely conventional, as is a generally conventional wall 19 including wooden wall stud means constituted by two adjoining two-by-four wall framing studs 20, 20 adjacent major face 13*b* of door jamb 13. The door jamb is mounted on the wall so that minor faces 13*c*, 13*d* or door jamb 13** extend substantially parallel to the wall.

As disclosed and claimed in my U.S. Pat. No. 4,074,484, the doorway framing also comprises a strong reinforcement plate 10, preferably of steel, such as 14-guage steel, consisting of major plate portion **10*a*, minor plate portion 10*b*, minor plate portion 10*c* interconnecting the major and minor plate portions. The major and minor plate portions define a plurality of screw holes to receive means for securely affixing the plate to the door framing, the illustrated means being threaded fastening elements, such as bolts or screws 11 and 12, penetrating deeply into the door framing parts to which plate 10 is affixed. As shown in the drawing, minor face 13*d* of the door jamb extends in a first plane spaced from minor plate portion 10*b* and the wall studs have a face extending in a second plane inwardly recessed from the first plane. Major reinforcement plate portion 10*a* is securely affixed to the recessed face of wall studs 20, 20 by bolts 11 and minor plate portion 10*b* is securely affixed to minor face 13*d* of the door jamb. The wall is shown to include an exterior wall including wall board 20' and facing 21, as well as an interior wall board 22** which may be, for instance, a gypsum board of plaster. Wall board 22 extends over major reinforcement plate portion 10*a* to web portion 10*c* and is flush with minor reinforcement plate portion 10*b*. Furthermore, molding 23, which may be of wood, covers minor face 10*b* of the door jamb and an adjoining portion of wall 19 whereby the reinforcement plate is hidden from view.

As disclosed in my copending application, steel backer plate 29 is arranged in the narrow space between major jamb face 13*b* and wall stud 20 in contact with major face 13*b* and in registry with striker plate 17*a*. Screw bolts extend through the jamb (see FIG. 2) to attach the backer plate and the striker plate together to the jamb.

As is shown in FIG. 1 at 17′, the door jamb has a weak point caused by the provision of door latch bolt hole 17 in the jamb and which could easily split or break if the door is kicked in but which is protected against such force by reinforcement plate 10 which extends perpendicularly thereto about six inches above and six inches below the center of the door latch hole. This weak point is also the location where burglars are likely to insert a burglar tool, such as a crowbar or screw driver, in an attempt to jimmy the door open. Such burglar tools have an elongated metal shaft which is electrically conductive.

Figure 3:
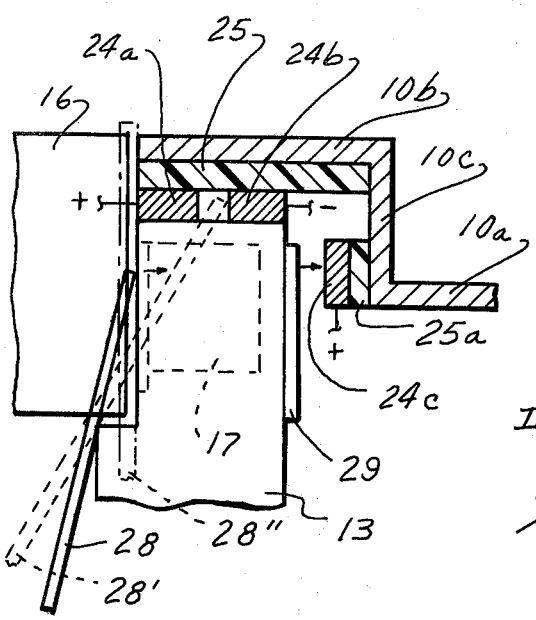
FIG. 3 is an enlarged transverse section showing the combination of the metal reinforcement plate and the electrically conductive sheets mounted thereon.

According to the present invention, a burglar alarm system will be set off in the event of such a jimmying attempt. This burglar alarm system comprises, as best shown in FIGS. 2 and 3, a pair of elongated electrically conductive sheets 24*a*, 24*b* are arranged between minor door jamb face 13*d* and the reinforcement plate. As shown in FIG. 4, conductive sheets 24*a*, 24*b* extend in side-by-side relationship along a major portion of minor reinforcement plate portion 10*b* and are electrically insulated from each other by an air gap therebetween. Electrically insulating sheets 25 is arranged between the steel reinforcement plate and the pair of conductive sheets.

Cooper being a readily available excellent electrical conductor, it is the preferred material for conductive sheets 24*a*, 24*b* but any suitable electrically conductive sheet material may be used for this purpose. The insulating sheet may be of a suitable synthetic resin material, any insulating material used normally in electrical insulation being effective.

The thickness of the electrically conductive and insulating sheets has been exaggerated in FIGS. 2 and 3, for sake of illustration, very thin-gauged sheets being effective for the purpose of this invention.

As shown in FIG. 5, which illustrates a conventional burglar alarm circuit merely by way of example, any such circuit being useful in combination with the invention, an electric control circuit 26 is connected to a burglar alarm and is energizable to set off the alarm, the circuit being connected by lead wires 27*a*, 27*b*, to electrically conductive sheets 24*a*, 24*b*.

In the preferred illustrated embodiment, and as an extra safeguard, another electrically conductive sheet 24*c* is arranged between major door jamb face 13*b* and reinforcement plate web portion 10*c*, this conductive sheet, too, being separated from the reinforcement plate by an electrically insulating sheet 25*a*. The other conductive sheet 24*c* is connected to conductive sheet 24*a*, as shown in broken lines in FIG. 4, these two conductors forming the positive pole of the alarm circuit. As also shown in this figure, conductive sheet 24*b* is connected to steel striker plate 29 and to steel reinforcement plate 10, these conductors forming the negative pole of the circuit.

FIG. 3 schematically illustrates three possible ways of setting off the alarm by forcing crowbar 28 or a like metal burglar tool in the usual manner between door 16 and door jamb 13. As shown in full lines, when burglar tool 28 is forced between the door and the jamb, the jamb will be pressed back. The distance between steel backer plates 29 and conductive sheet 24*c* being about ⅛″ or less, these two conductors of opposite polarity will make contact, thus actuating the burglar alarm. Alternatively and as shown in broken lines in FIG. 3, if burglar tool 28′ is forced through latch bolt hole 17 and penetrates through weak jamb area 17′, it will make contact between conductors 24*a* and 24*b* of opposite polarity, which actuates the burglar alarm, too (in case the jamb had not been pressed back to make contact between conductors 29 and 24*c*. Finally and as shown in chain-dotted lines in FIG. 3, if burglar tool 28′ is forced between the door and the striker plate, the toll will glide along conductor 24*a* and into contact with minor steel plate portion 10*b*, again setting off the alarm. In other words, the alarm will be sounded in whatever way the burglar tool is used in an attempt to jimmy the door.

As schematically illustrated in FIG. 5, the conventional burglar alarm circuit itself includes battery 27 as an electric power source and a relay 30 with a normally open contact 30*a*, electrically conductive sheet 24*b* being connected to battery 27 and electrically conductive sheet 24*a* being connected to the alarm which is also connected to the power source. When insertion of the burglar tool makes electrical contact between two electrically conductive sheets, circuit 26 is energized and contact 28*a* is closed. This contact remains closed even after the tool is withdrawn and until it is reset, i.e. manually opened, so that the burglar alarm keeps sounding.

While the insulating and conductive sheets may be affixed to the door framing in any suitable manner in the illustrated position, FIG. 4 illustrates a preferred fastening making use of bolts or screws 12 which affix the reinforcement plate to the door jamb.

What is claimed is:

1. A burglar alarm system mounted in a doorway framing which comprises a wooden door jamb having two substantially parallel major faces and two minor faces substantially perpendicular to the major faces, one of the major faces having a recessed end portion delimited by one of the minor faces and a shoulder constituting a stop for a door, and the door jamb defining a door latch bolt hole in the recessed end portion, a wall including wooden wall stud means adjacent the other major face of the door jamb, the door jamb being mounted on the wall and the minor faces of the door jamb extending substantially parallel to the wall, and a reinforcement metal plate extending over a substantial portion of the wall stud means and a substantial portion of the one minor face of the door jamb, the reinforcement plate being securely affixed to the wall stud means and the one minor face of the door jamb and covering a substantial region of the minor door jamb face adjacent and beyond the door latch bolt hole, the securely affixed plate holding the door jamb firmly in position, the burglar alarm system comprising (a) a pair of elongated electrically conductive sheets arranged between the minor door jamb face and the reinforcement plate, the electrically conductive sheets extending in side-by-side relationship along a major portion of the reinforcement plate and being electrically insulated from each other, (b) an electrically insulating sheet arranged between the reinforcement plate and the pair of electrically conductive sheets, (c) a burglar alarm, and (d) an electric control circuit connected to the burglar alarm and energizable to set off the alarm, the circuit being connected to the electrically conductive sheets and being energized upon electrical contact being made between the sheets.

2. The burglar alarm system according to claim 1, wherein the control circuit includes an electric power source and a relay with a normally upon contact, one of the electrically conductive sheets being connected to the power source and the other electrically conductive sheet being connected to the alarm, the alarm also being connected to the power source.

3. The burglar alarm system according to claim 2, wherein the power source is a battery having two poles, one of the poles being connected to the one conductive sheet and the other pole being connected to the alarm.

4. The burglar alarm system according to claim 1, wherein the metal reinforcement plate has a web portion extending substantially parallel to the other major face of the door jamb and spaced therefrom, another electrically conductive sheet is arranged between the other major door jamb face and the reinforcement plate web portion, and an electrically insulating sheet is arranged between the reinforcement plate web portion and the other conductive sheet, the other conductive sheet being connected to one of the conductive sheets of the pair, and a metal backer plate is mounted on the other major face of the door jamb, the metal backer plate being spaced from and facing the other conductive sheet, and the backer plate being connected to the other conductive sheet of the pair.

5. The burglar alarm system according to claim 4, wherein the electrically conductive sheets are of copper.

6. The burglar alarm system according to claim 4, wherein the reinforcement metal plate is also connected to the other conductive sheet of the pair.

7. The burglar alarm system according to claim 1, further comprising a plurality of elongated threaded fastening elements penetrating deeply into the door jamb for securely affixing the reinforcement plate thereto, the electrically conductive sheets being spaced from each other to permit passage of the fastening elements therebetween and the fastening elements holding the conductive sheets in position, electrically insulating rings surrounding the fastening elements to insulate the conductive sheets therefrom.

* * * * *